US011427446B2

(12) United States Patent
Heintz

(10) Patent No.: US 11,427,446 B2
(45) Date of Patent: Aug. 30, 2022

(54) VEHICLE CRANE HAVING A TELESCOPING JIB AND VEHICLE CRANE SYSTEM AND METHOD FOR MOUNTING A BRACING APPARATUS ON THE TELESCOPING JIB OF A VEHICLE CRANE

(71) Applicant: Tadano Demag GmbH, Zweibrücken (DE)

(72) Inventor: Rolf Heintz, Langwieden (DE)

(73) Assignee: Tadano Demag GmbH, Zweibrücken (DE)

( * ) Notice: Subject to any disclaimer, the term of this patent is extended or adjusted under 35 U.S.C. 154(b) by 130 days.

(21) Appl. No.: 17/091,185

(22) Filed: Nov. 6, 2020

(65) Prior Publication Data

US 2021/0139296 A1 May 13, 2021

(30) Foreign Application Priority Data

Nov. 8, 2019 (DE) ..... 102019130241.2

(51) Int. Cl.
*B66C 23/70* (2006.01)
*B66C 23/42* (2006.01)
*B66C 23/82* (2006.01)

(52) U.S. Cl.
CPC ..... *B66C 23/702* (2013.01); *B66C 23/42* (2013.01); *B66C 23/703* (2013.01); *B66C 23/707* (2013.01); *B66C 23/821* (2013.01); *B66C 23/826* (2013.01); *B66C 23/705* (2013.01)

(58) Field of Classification Search
CPC ..... B66C 23/42; B66C 23/64; B66C 23/68; B66C 23/702; B66C 23/821; B66C 23/823
See application file for complete search history.

(56) References Cited

U.S. PATENT DOCUMENTS 7,686,174 B2 * 3/2010 Willim ..... B66C 23/42 212/270
2020/0002139 A1 * 1/2020 Backes ..... B66C 23/828

FOREIGN PATENT DOCUMENTS

| | | | |
|---|---|---|---|
| DE | 102009020338 | A1 | 11/2010 |
| DE | 102017000389 | A1 | 7/2018 |
| DE | 102018115632 | B3 | 10/2019 |
| EP | 1342692 | B1 | 6/2008 |
| EP | 2248754 | B1 | 6/2014 |

* cited by examiner

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A vehicle crane having a telescoping jib, comprising a basic box with linearly displaceable inner boxes and a lifting cable with a load picking-up device. A fastening region is arranged on the basic box or on a head end of one of the inner boxes, and a bracing apparatus is securable to the fastening region by a connecting end. To simplify rigging/de-rigging of the vehicle crane in relation to the bracing apparatus, the fastening region is formed for mounting the bracing apparatus on the basic box or on one of the inner boxes such that a bracing apparatus that is freely suspended on the lifting cable is coupled to the fastening region with the connecting end being brought close to the fastening region by movements of the vehicle crane, retraction and extension of the inner boxes, raising and lowering of the load picking-up device, and/or luffing of the telescoping jib.

17 Claims, 11 Drawing Sheets

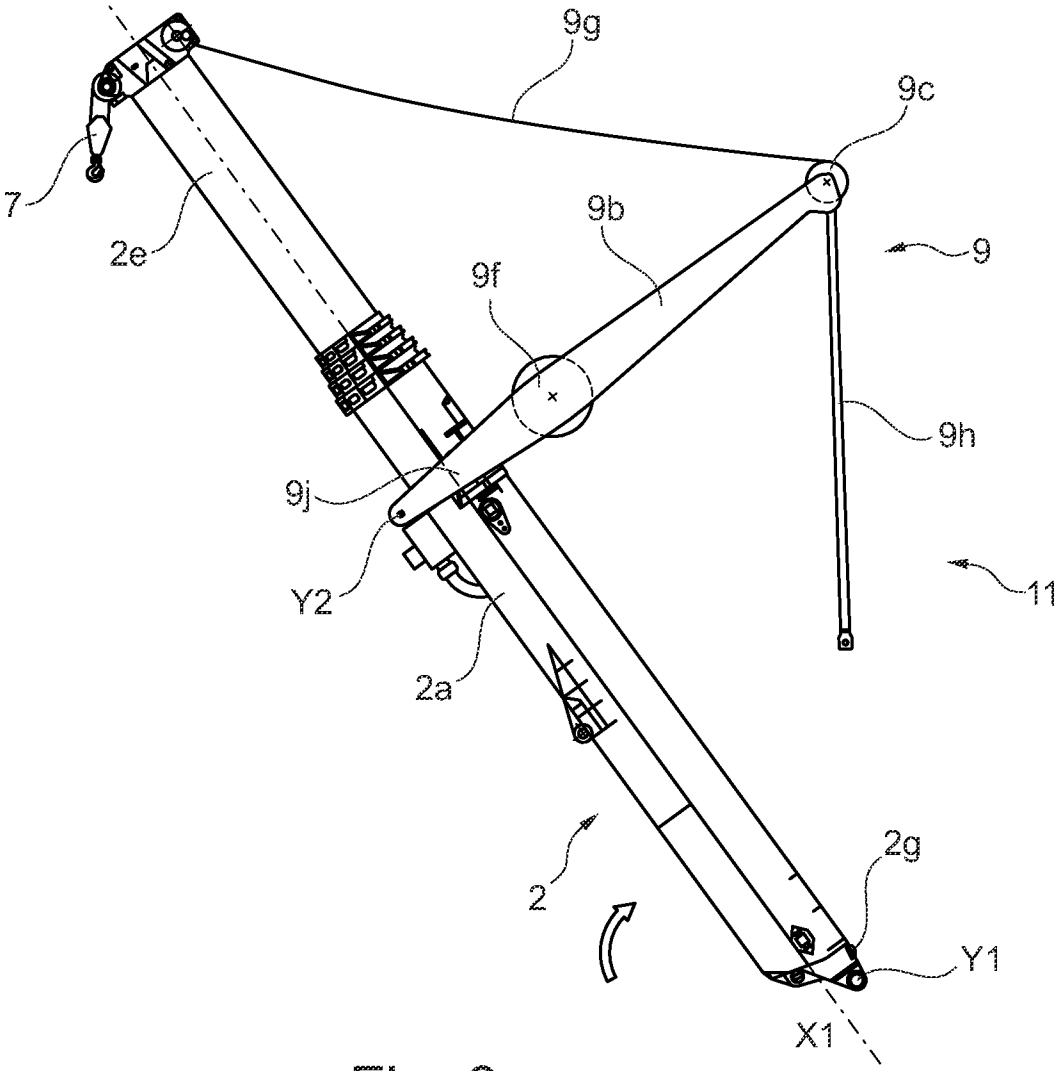
Fig. 8
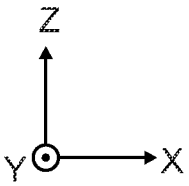

VEHICLE CRANE HAVING A TELESCOPING JIB AND VEHICLE CRANE SYSTEM AND METHOD FOR MOUNTING A BRACING APPARATUS ON THE TELESCOPING JIB OF A VEHICLE CRANE

CROSS REFERENCE TO RELATED APPLICATION

The present application claims the priority benefits of German application DE 102019130241.2, filed Nov. 8, 2019.

BACKGROUND AND FIELD OF THE INVENTION

The invention relates to a vehicle crane having a telescoping jib, comprising a basic box having linearly displaceable inner boxes and having a lifting cable having a load picking-up means, wherein a fastening region is arranged on the basic box or on a head end of the inner boxes, a bracing apparatus being able to be secured to the fastening region by means of a connecting end. The invention also relates to a method for mounting a bracing apparatus on a telescoping jib of a vehicle crane.

Typically, the factors determining how vehicle cranes, in particular mobile cranes, can be used are set by the structural design thereof. Variables such as load-bearing capacity, working radius and lifting height are determined essentially by the design of the respective telescoping jib. By using a bracing apparatus which can be coupled to the telescoping jib, the variables of a vehicle crane can at times be changed in order for instance to increase its load-bearing capacity and reduce the elastic deflection of its telescoping jib. Such a bracing device can be e.g. a so-called lateral superlift, the arrangement of which can serve to advantageously reduce the lever arm of the telescoping jib. The increase in load rendered possible thereby is mostly produced by the combination with an additional counterweight and corresponding deflectors over this bracing device.

Owing to the mostly very considerable weight of such vehicle cranes, said cranes often arrive at their respective place of usage only in a partially disassembled manner in order to be able to respect the maximum values for the axial load and vehicle weight which are set for travelling on public roads. In this context, European patent EP 1 342 692 B1 discloses a vehicle crane system which, in addition to the vehicle crane, comprises a transport unit formed to transport the bracing device. The vehicle crane itself comprises a telescoping jib having a basic box and linearly displaceable inner boxes. The vehicle crane and telescoping jib are configured such that a temporary storage region for the bracing apparatus is provided on both sides of the luffed-down telescoping jib. On site, the separately transported bracing apparatus is raised from the transport unit by the telescoping jib and is intermediately stored on the storage region of the vehicle crane. Then, the telescoping jib is luffed-down into a substantially horizontal rigging position in which the bracing apparatus can be secured to a fastening region located on the basic box of the telescoping jib.

German laid-open document DE 10 2009 020 338 A1 and European patent EP 2 248 754 B1 disclose a similarly designed vehicle crane system. Specifically, in these cases the bracing apparatus is also brought to the place of usage on a separate transport unit and raised by means of the telescoping jib of the vehicle crane. However, the bracing apparatus is then partially supported on the ground and partially supported on a small storage region of the vehicle crane. For this purpose, the bracing apparatus comprises a support device which can be folded out. The free space hereby remaining between the ground and the bracing apparatus is used in order to arrange the correspondingly luffed-down telescoping jib by moving the vehicle crane beneath the bracing apparatus and to then couple same to the basic box of the telescoping jib.

The known designs always require an intermediate storage of the accommodated bracing apparatus on the ground or on a storage region, formed for this purpose, on the vehicle crane, in order to allow the rigging/de-rigging thereof. In addition, these always require a precise orientation of the telescoping jib opposite the direction of travel and in parallel with the longitudinal direction of the vehicle crane in order to be able to accommodate and store the bracing apparatus to be at least partially supported on the storage region thereof. Particularly in the case of uneven or unstable ground, the at least end-side support of the bracing apparatus thereon can be made difficult. Forming an additional storage region on the vehicle crane likewise gives rise to disadvantages in that the installation space required for this purpose must be kept free and therefore cannot be used for other purposes, or can only be used with difficulty. On the whole, there is still room for improvement in this respect in the previously disclosed embodiments in the prior art.

Moreover, a further telescoping jib bracing unit for a mobile crane is known from German patent DE 10 2018 115 632 B3. The telescoping jib bracing unit consists of two bracing supports connected by a substantially u-shaped holding frame to form a structural unit. The u-shaped holding frame comprises two frame parts which are connected together in a pincer-like manner and can be pivoted from a wide accommodating position into a narrow fastening position. In order to fasten the telescoping jib bracing unit on the telescoping jib of the mobile crane, the telescoping jib is lowered from above into the holding frame in the accommodating position, the frame parts are then pivoted into the fastening position and connected to a basic box of the telescoping jib.

Furthermore, a method for attaching bracing supports to a telescoping jib of a mobile crane is already known from German laid-open document DE 10 2017 000 389 A1. For this purpose, the bracing supports are placed on a lower carriage of the mobile crane, and so when the telescoping jib is luffed-down the bracing supports are arranged in parallel and at the same height on both longitudinal sides next to the telescoping jib. Then, the bracing supports are each connected to the telescoping jib via a hinged connection, by means of which an operating position of the bracing supports, protruding from the telescoping jib, can be achieved. The respective storage elements of the bracing supports are brought into their storage position in which the storage element protrudes from the telescoping jib, and so a means for positioning the bracing support cooperates with the storage element in order to prevent the bracing support from swinging out laterally.

SUMMARY OF THE INVENTION

The present invention provides an improved vehicle crane having a telescoping jib and a bracing apparatus, which can be mounted thereon, for a vehicle crane and a method for mounting a bracing apparatus on a telescoping jib of a vehicle crane in such a manner that the rigging/de-rigging of the vehicle crane in relation to the bracing apparatus is simplified.

In accordance with an embodiment of the invention, in a vehicle crane having a telescoping jib, comprising a basic box having linearly displaceable inner boxes and having a lifting cable having a load picking-up means, wherein a fastening region is arranged on the basic box or on a head end of one of the inner boxes, a bracing apparatus being able to be secured to the fastening region by means of a connecting end, simplified rigging/de-rigging of the vehicle crane in relation to the bracing apparatus is achieved by virtue of the fact that the fastening region is formed for mounting the bracing apparatus on the basic box or on one of the inner boxes in such a manner that a bracing apparatus which is freely suspended on the lifting cable and with the connecting end is brought close to the fastening region by movements of the vehicle crane, by means of retraction and extension of the inner boxes, raising and lowering of the load picking-up means and/or luffing of the telescoping jib, is coupled to the fastening region.

A particular feature of the present invention is that of manoeuvring a bracing apparatus—which is freely suspended on the load picking-up means of the vehicle crane to be fitted with the bracing apparatus—to the fastening region with its connecting end via the aforementioned possibilities of moving the vehicle crane. In order to couple the bracing apparatus to the fastening region, mechanical elements are arranged on the basic box or on the head end of the relevant inner box and, opposite thereto, on the connecting end of the bracing apparatus. These mechanical elements are engaged with each other via linear, arcuate and/or circular joining movements towards each other. The following possible designs for the mechanical elements can be considered: hooks which grasp a pin with their opening and/or pin-shaped or bolt-shaped plug elements which are moved into corresponding complementarily formed plug openings. After the coupling process is complete, the completed coupling is secured in position via the mechanical elements in a subsequent step via bolts or comparable elements. The securing process is preferably effected automatically or semi-automatically because the securing location is typically located in the region of 5 to 10 m above the ground on which the vehicle crane is resting. Moreover, in the region of the mechanical elements to be moved towards each other and thus also in the fastening region, guide elements in the form of flat and substantially funnel-shaped deflectors can be provided which facilitate the movement of guiding the bracing apparatus towards the fastening region.

This new inventive way of bringing the bracing apparatus close to the fastening region additionally has the great advantage that a transport unit, on which the bracing apparatus is transported separately from the vehicle crane, only has to be roughly orientated with respect to the vehicle crane prior to the accommodation of the bracing apparatus by the transport unit by the vehicle crane because the actual orientation of the bracing apparatus suspended on the load picking-up means occurs virtually automatically with respect to the telescoping jib. For this purpose, the load picking-up means is then selected such that the load picking-up means is formed rigid in relation to a vertical axis of rotation, which typically coincides with the longitudinal direction of the lifting cables and the guiding of the load picking-up means over the cable reeving of the lifting cable is sufficient to orientate the bracing apparatus with its longitudinal direction lying in a luffing plane of the telescoping jib automatically for the coupling process. If the load picking-up means comprises a load hook rotatable about a vertical axis and a load suspension for picking up the bracing apparatus, it is typical to provide guide cables freely suspended downwards on the bracing apparatus, via which auxiliary personnel can then orientate the bracing apparatus into the desired position with respect to the telescoping jib. It would also be feasible for load picking-up means to be fitted with a rotary apparatus, in particular a remotely operable rotary apparatus, in order to orientate the bracing apparatus with respect to the telescoping jib prior to coupling about a vertical axis. The required precise orientation between the bracing apparatus and the telescoping jib can also be effected via the designs of the mechanical elements for the coupling process and thus by the coupling process. By omitting the otherwise necessary storage regions for the bracing apparatus on the vehicle crane, said crane can also be configured more advantageously on the whole. For instance, the regions which would otherwise have to be kept available can now be used for different purposes or can be at least partially omitted for the benefit of a design which is narrower on the whole to reduce the dimensions.

In a further embodiment the invention provides a vehicle crane on which a first plug connection part is arranged on the basic box or one of the inner boxes in the fastening region. The plug connection part is configured to form a mechanical plug connection with the bracing apparatus: for this purpose, the first plug connection part of the telescoping jib is formed such that it can be coupled to a respectively corresponding second plug connection part on the connecting end of the bracing apparatus. In other words, the inventive design provides the releasable connection in regions, in particular a plug-in connection and/or bolting, between the bracing apparatus and the telescoping jib in order to obtain a load-bearing connection therebetween.

The advantage produced thereby is that the actual orientation of the telescoping jib with respect to the bracing apparatus is initially irrelevant in order to establish the plug connection between the telescoping jib and the bracing apparatus. The design as a plug connection allows the bracing apparatus to be secured to the telescoping jib in an extremely simple manner because a load-bearing connection is already established immediately after the elements are plugged together. In addition, basically no intermediate storage is required during rigging and de-rigging. For instance, on the one hand the telescoping jib can be coupled to the bracing apparatus directly after the accommodating thereof. On the other hand, the bracing apparatus can be removed from the telescoping jib after disconnecting the plug connection and can be stored e.g. on a transport unit. On the whole, the design as a plug connection permits rigging and de-rigging which is as simple as it is rapid, in order to be able to secure the bracing apparatus to the telescoping jib and release same therefrom.

Moreover, it is advantageous that space for mounting cable drums on the basic box is provided by virtue of the fact that the releasable connection between the bracing apparatus and the telescoping jib occurs in the region of the lower side of the respective inner box or basic box.

In accordance with a preferred development of the basic inventive concept, the first plug connection part can comprise an opening channel provided to at least partially accommodate the second plug connection part. The extension thereof defines the orientation of a plug axis, along which the two plug connection parts can be coupled and separated. For this purpose, the plug axis can extend in parallel with a longitudinal axis of the basic box and in this respect of the entire telescoping jib, in order to ensure coupling which is a simple as possible. In a particularly advantageous manner, the opening channel can be configured such that it permits an at least partially form-fitting accommodation of the second connection part of the bracing apparatus.

Alternatively or in addition thereto, the first plug connection part of the basic box can comprise at least one plug element which is provided for being at least partially arranged in an opening channel of the second plug connection part of the bracing apparatus. The extension of the plug element defines the orientation of a plug axis, along which the two plug connection parts can be coupled and separated. For this purpose, the plug axis can extend in parallel with a longitudinal axis of the basic box and in this respect of the entire telescoping jib, in order to ensure coupling which is a simple as possible. In a particularly advantageous manner, the plug element can be configured such that it permits an at least partially form-fitting arrangement in the opening channel of the second connection part of the bracing apparatus.

With respect to the basic box and each inner box of the telescoping jib, this has an upper side and a lower side. The lower side is considered to be the side of the basic box or inner box which is facing the respective ground when the telescoping jib is orientated horizontally. The upper side is then the side of the basic box or inner box opposite the lower side. In this context, it is considered to be particularly advantageous if the first plug connection is arranged on the lower side of the basic box or inner box. In this manner, the bracing apparatus does not have to be first raised above the basic box or inner box in order to be secured. Rather, the coupling occurs in that the bracing apparatus has to be brought close to the basic box or the inner box of the telescoping jib virtually from below.

The inventive vehicle crane having a telescoping jib thus permits extremely simple rigging/de-rigging in relation to a bracing apparatus. As part of a vehicle crane, where the telescoping jib is typically articulated in a luff able manner on the superstructure thereof, the bracing apparatus can also be coupled and decoupled independently of the orientation of the telescoping jib with respect to the rest of the vehicle crane. In the previously known designs, the superstructure which is usually rotatable relative to the lower carriage of a vehicle crane together with the telescoping jib initially has to be orientated in this respect such that the longitudinal axis of the telescoping jib extends in parallel with the longitudinal direction of the vehicle crane. The superstructure is rotated with respect to the lower carriage such that the telescoping jib extends in the direction of the rear end of the vehicle crane, or even beyond same. Only in this orientation is the otherwise necessary storage region of the vehicle crane available in order to support the bracing apparatus at least partially thereon. In particular in combination with a transport unit which separately transports the bracing apparatus, the rigging/de-rigging thus requires a more complex orientation and positioning of all parts involved with respect to each other. In this case, the inventive design provides a substantially more simple usage which—owing to the omission of the intermediate storage of the bracing apparatus—requires at least one working step less and moreover is independent of the relative orientation of the lower carriage with respect to the superstructure and the vehicle crane as a whole with respect to the transport unit.

In an advantageous manner, the bracing apparatus has a second plug connection part corresponding to the first plug connection part of the telescoping jib, which permits a simple coupling by forming a plug connection.

Basically, the second plug connection part can be articulated in a particularly preferred manner on the bracing apparatus so that it can be pivoted at least partially relative to the rest of the bracing apparatus. The hereby produced mobility allows the second plug connection part to be orientated with the first plug connection part of the telescoping jib, even prior to securing the bracing apparatus on the telescoping jib, and in particular independently of the spatial position of the rest of the bracing apparatus.

The invention makes provision for the bracing apparatus to be able to have two articulated bracing supports and at least one drive. The articulated mounting of the bracing supports allows the pivotability thereof in particular relative to the second plug connection part. The at least one drive, in particular hydraulic drive, is used for the at least partial pivoting of the two bracing supports. When the bracing apparatus is coupled to the basic box or one of the inner boxes of the telescoping jib, the bracing supports can thus be pivoted from a mounting position into a working position and back. The mounting position is understood to mean the particular orientation of the bracing supports which is assumed during rigging and de-rigging in this respect prior to coupling and de-coupling the bracing apparatus with the telescoping jib. In contrast, the working position is understood to mean the particular orientation of the bracing supports which is pivoted with respect to the mounting position and is used to actually stiffen the telescoping jib by the bracing apparatus. The drive can also be electric. Rotary mechanisms or linear drives can also be used.

In accordance with a preferred development of the vehicle crane in accordance with the invention, the first plug connection part and/or the second plug connection part can comprise an insertion aid in order to facilitate, in particular, the mutual coupling thereof. In an advantageous manner, said insertion aid can be implemented in the form of at least one oblique surface arranged on the first plug connection part and/or second plug connection part. This oblique surface should be configured such that at least one of the regions of the two plug connection parts initially in contact with each other during coupling has a narrowing or a widening. In other words, such an oblique surface can be used e.g. to widen the front portion of the opening channel of a plug connection part which facilitates the insertion of a plug element corresponding to the opening channel. Alternatively or in addition, the oblique surface can be used e.g. to narrow the front portion of such a plug element in order to facilitate the insertion thereof into a corresponding opening channel. In either case, the oblique surface allows a certain tolerance in the orientation of the two plug connection parts with respect to each other before the actual plug connection is formed by said parts being brought closer together.

Furthermore, the invention is directed to a vehicle crane system which comprises an inventive vehicle crane having a telescoping jib, as discussed above, and a transport unit formed for transporting the bracing apparatus for the telescoping jib.

The vehicle crane system in accordance with the invention also provides on the whole the advantages explained in more detail above in conjunction with the inventive telescoping jib and/or the telescoping jib system, and so at this juncture reference is made once again to the corresponding statements in that regard to avoid repetition.

The invention is also directed to a method for mounting a bracing apparatus on a telescoping jib of a vehicle crane. The method comprises the following steps: providing a transport unit having the bracing device, accommodated thereon, in the region of the vehicle crane; moving, in particular linearly displacing, at least one inner box of the telescoping jib and/or luffing the telescoping jib and/or rotating a superstructure of the vehicle crane carrying the telescoping jib, until a load picking-up means of the telescoping jib is arranged in a region above the bracing device; connecting a load picking-up means of the vehicle crane to the bracing apparatus, in particular incorporating a suspension; raising the bracing apparatus from the transport unit by means of the vehicle crane; moving the bracing apparatus freely suspended on the lifting cable with its connecting end by means of retraction and extension of the inner boxes, raising and lowering of the load picking-up means and/or luffing of the telescoping jib with respect to a fastening region on a basic box or on a head end of one of the inner boxes with respect to a fastening region; coupling the bracing apparatus to the fastening region of the basic box or one of the inner boxes; and releasing the load picking-up means of the vehicle crane from the bracing apparatus.

The method in accordance with the invention permits the extremely simple relocation of a bracing apparatus from a transport unit to the telescoping jib of a vehicle crane. For this purpose, only a few steps are required which substantially permit automatic rigging of the vehicle crane. In particular, the thereby irrelevant orientation of the superstructure carrying the telescoping jib relative to the bracing apparatus and the securing of the bracing apparatus on the basic box or one of the inner boxes of the telescoping jib without support in the meantime in storage regions of the vehicle crane, which would otherwise have to be kept available, considerably facilitate and reduce the measures to be performed for rigging the vehicle crane on site.

In an advantageous manner, a type of automatic and thus simple coupling is achieved by virtue of the fact that the bracing apparatus is coupled to the fastening region by moving the bracing apparatus freely suspended on the lifting cable. In a preferred embodiment, the coupling process is ended by virtue of the fact that the bracing apparatus is mechanically secured after coupling to the fastening region. In an advantageous embodiment, provision is made that a second plug connection part is coupled to the bracing apparatus by means of a first plug connection part corresponding to the second plug connection part. In an advantageous manner, the orientation of the first plug connection part and the second plug connection part is selected such that the first plug connection part can be coupled to the second plug connection part by retracting at least one of the inner boxes.

The invention makes provision for two bracing supports articulated on the bracing apparatus to be pivoted from a mounting position to a working position after rigging of the telescoping jib with the bracing apparatus. In an advantageous manner, the bracing supports can be pivoted at least partially by at least one drive.

In a particularly advantageous manner, provision is made that the bracing device is orientated with its longitudinal extension in parallel with the longitudinal extension of the telescoping jib prior to coupling. The orientation of the bracing apparatus with respect to the telescoping jib is effected in a virtually automatic manner because the bracing apparatus is suspended on the load picking-up means. For this purpose, the load picking-up means is then selected such that the load picking-up means is formed rigid in relation to a vertical axis of rotation which typically coincides with the longitudinal direction of the lifting cables and the guiding of the load picking-up means over the cable reeving of the lifting cable is sufficient to orientate the bracing apparatus with its longitudinal direction lying in a luffing plane of the telescoping jib automatically for the coupling process. If the load picking-up means comprises a load hook rotatable about a vertical axis and a load suspension for picking up the bracing apparatus, it is typical to provide guide cables freely suspended downwards on the bracing apparatus, via which auxiliary personnel can then orientate the bracing apparatus into the desired position with respect to the telescoping jib. It would also be feasible for load picking-up means to be fitted with a rotary apparatus, in particular a remotely operable rotary apparatus, in order to orientate the bracing apparatus with respect to the telescoping jib prior to coupling about a vertical axis. The required precise orientation between the bracing apparatus and the telescoping jib can also be effected via the designs of the mechanical elements for the coupling process and thus by the coupling process.

The advantages achieved by the method in accordance with the invention have incidentally already been disclosed or at least analogously discussed in conjunction with the inventive vehicle crane having the telescoping jib and so at this juncture reference is also made on the whole to the previous statements in that regard to avoid repetition.

It is self-evident that the previously described advantages in conjunction with the mounting of the bracing apparatus on the telescoping jib of a vehicle crane are also achieved in conjunction with demounting of the bracing apparatus from the telescoping jib.

An exemplified embodiment of the invention will be explained in greater detail with reference to the following description and drawings.

BRIEF DESCRIPTION OF THE DRAWINGS

FIG. 8 shows the vehicle crane system from FIG. 7 with a luffed-up telescoping jib.

DESCRIPTION OF THE PREFERRED EMBODIMENTS

Figure 1:
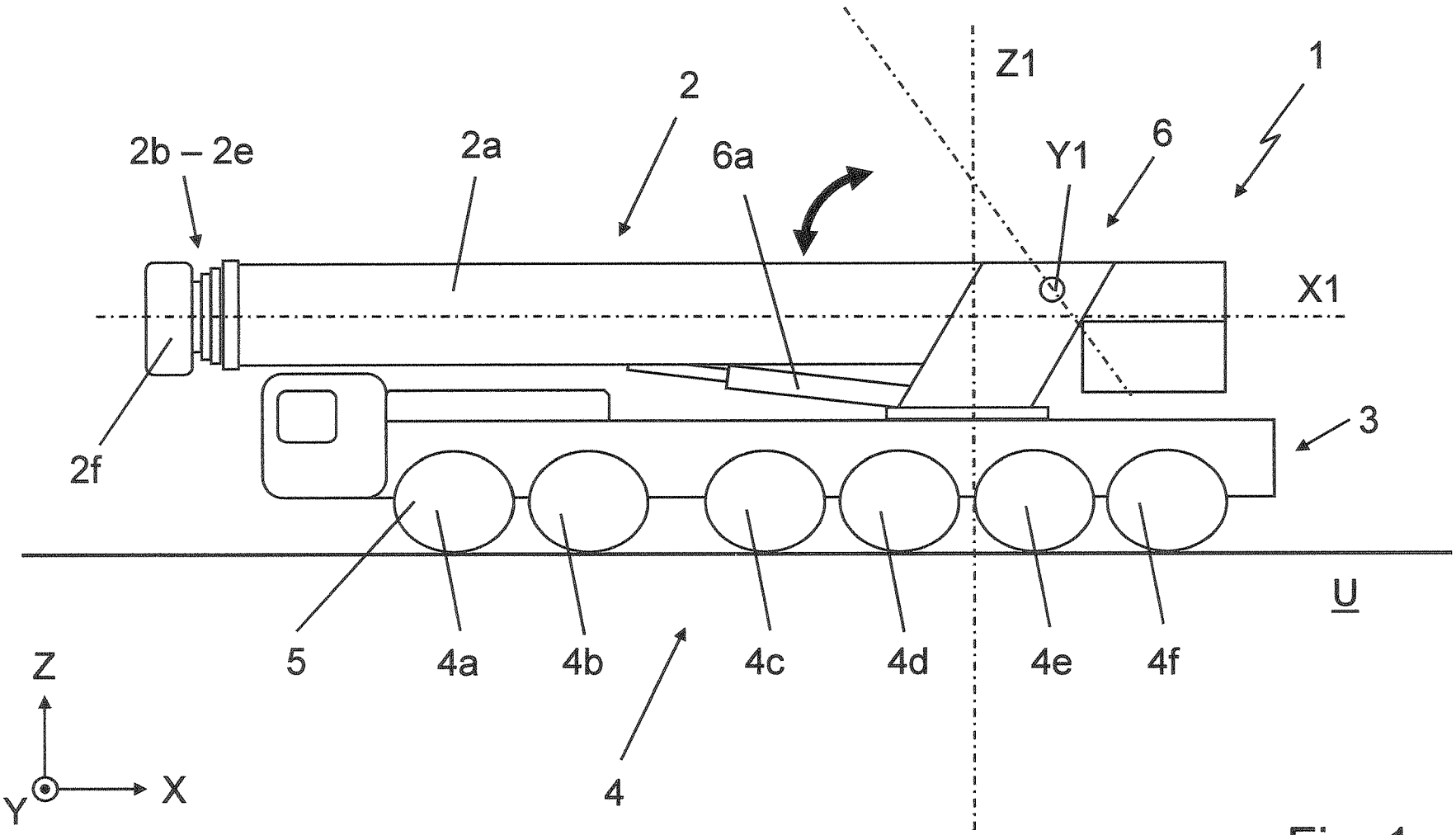
FIG. 1 shows a schematic view of a vehicle crane.

FIG. 1 shows a schematic view of a vehicle crane 1 which is parked on the ground U and has a telescoping jib 2 which, in a transport position, extends with its longitudinal direction X1 in the present case in parallel with a horizontal direction X. The telescoping jib 2 with its telescoping jib head 2*f* is illustrated in a purely schematic manner and is not formed in accordance with the invention. The vehicle crane 1 has a lower carriage 3 which, in the example shown here, comprises a wheeled running gear unit 4 which includes on the whole six axles 4*a* to 4*f* each having at least two wheels 5 mounted to be rotatable on the axles and spaced apart from each other in parallel with a vertical direction Y. Arranged on the lower carriage 3 is a superstructure 6 which carries the telescoping jib 2 and can be rotated relative to the lower carriage 3 about an axis of rotation Z1 extending in parallel with an upwards direction Z. The telescoping jib 2 extending in its longitudinal direction X1 is articulated on the superstructure 6 via a horizontal luffing axis Y1.

The telescoping jib 2 has a basic box 2*a* which is articulated in a luffable manner on the superstructure 6 and contains a plurality of inner boxes 2*b* to 2*e*. Owing to their stepped cross-sections matched to each other, the inner boxes 2*b* to 2*e* are arranged one inside the other and within the basic box 2*a* such that these can be displaced, in particular can be hydraulically retracted and extended, accordingly linearly in the longitudinal direction X1 of the telescoping jib 2. The telescoping jib 2 is luffable accordingly via at least one linear drive acting between the basic box 2*a* and the superstructure 6 in the design as a luffing cylinder 6*a*. A load lifting device or pick-up device or picking-up means 7 is arranged on the free end of the telescoping jib 2 via a lifting cable (see FIG. 2) in order to be able to pick up a load. The load picking-up means 7 is typically formed as a load hook having a lower block for a cable reeving.

Figure 2:
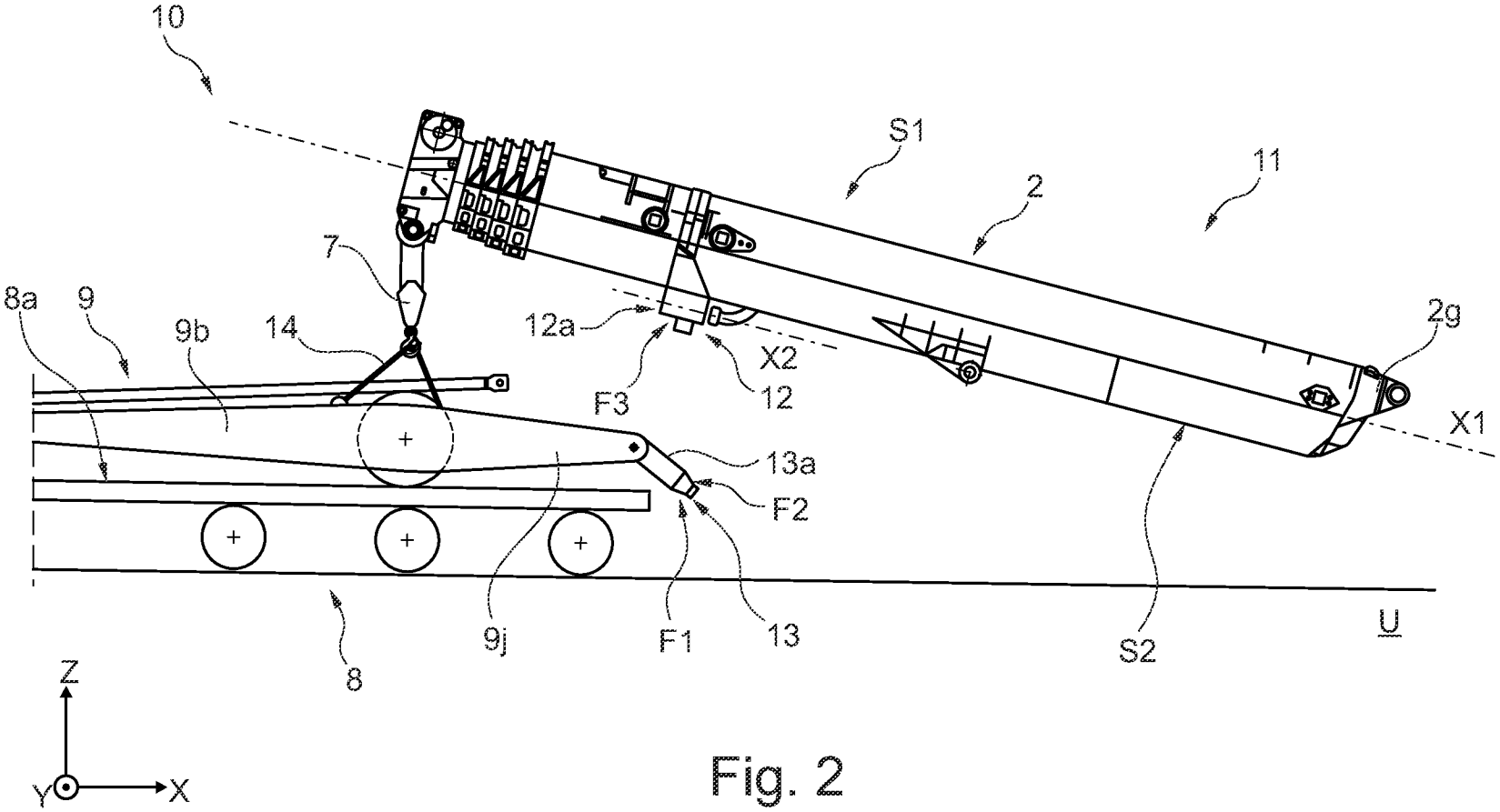
FIG. 2 shows a side view of an inventive vehicle crane system having a vehicle crane, reduced to an inventive telescoping jib, from FIG. 1 and a bracing apparatus located on a transport unit.

FIG. 2 shows the vehicle crane 1 from FIG. 1 reduced to its telescoping jib 2, together with a brace or bracing apparatus 9 stored in a transport position on a transport unit 8, only sections of which are indicated in the figure. The telescoping jib 2 is illustrated in FIG. 2 in a design in accordance with the invention. The transport unit 8 is formed e.g. as a semi-trailer, but it can also be a trailer.

Such bracing apparatuses 9 are generally known and substantially consist of two bracing supports 9*b*, of which only a front, or left, one is shown in FIG. 2. The two bracing supports 9*b* are connected together at their respective inner ends via a connecting frame which is likewise concealed, and so the two bracing supports 9*b* can be pivoted from a mutually parallel transport position into an operating position orientated in a substantially v-shaped manner with respect to each other.

The telescoping jib 2 and bracing apparatus 9 form a telescoping jib system 10 in accordance with the invention. The vehicle crane 1 from FIG. 1 equipped with the telescoping jib system 10 and the transport unit 8 formed for transporting the bracing apparatus 9 of the telescoping jib system 10 form a vehicle crane system 11 in accordance with the invention.

In the illustration of the telescoping jib 2, which is separate from the vehicle crane 1 in this figure, it is clear that the jib has a fastening region in which a first plug connection part 12 is arranged. Compared therewith, the bracing apparatus 9 has at a connecting end 9*j* a second plug connection part 13 which corresponds to the first plug connection part 12 of the telescoping jib 2, wherein the two plug connection parts 12, 13 can be coupled together to secure the bracing apparatus 9 to the basic box 2*a* forming a plug connection. The telescoping jib 2 has an upper side S1 and a lower side S2 which is opposite the upper side S1 and substantially faces the ground U, wherein the first plug connection part 12 is visibly arranged on the lower side S2 of the telescoping jib 2 and between the head of the basic box 2*a* and a receptacle for the luffing cylinder 6*a*.

In the design of the two plug connection parts 12, 13 which is shown by way of example only here, the first plug connection part 12 has an opening channel 12*a* which is open at least in the direction of the head of the basic box 2*a*, whilst the second plug connection part 13 has a plug element 13*a* articulated on an inner end of the bracing apparatus 9. The extension of the opening channel 12*a* defines a plug axis X2 which extends in parallel with the longitudinal axis X1 of the basic box 2*a* and thus the telescoping jib 2. The two plug connection parts 12, 13 are formed at least in regions in a form-fitting manner with respect to each other. In the design which is shown by way of example only here, it can be seen that the two plug connection parts 12, 13 each have at least one oblique surface F1, F2; F3, of which two oblique surfaces F1, F2 are arranged on the second plug connection part 13 whilst one oblique surface F3 is located on the first plug connection part 12. The two oblique surfaces F1, F2 of the second plug connection part 13 are orientated with respect to each other such that the plug element 13*a* narrows towards its free end. The single oblique surface F3 of the first plug connection part 12 is located such that the opening channel 12*a* widens in a wedge-shaped manner opposite an insertion direction. The oblique surfaces F1, F2; F3 are used as an insertion aid in order to be able to couple the two plug connection parts 12, 13 together more effectively.

In the situation which can be seen in FIG. 2, the bracing apparatus 9 stored on a loading surface 8*a* of the transport unit 8 is already coupled to the load picking-up means 7 of the telescoping jib 2 incorporating a suspension 14. The suspension 14 is connected to the bracing apparatus 9 such that the bracing apparatus 9 is suspended substantially horizontally on the load picking-up means 7.

Figure 3:
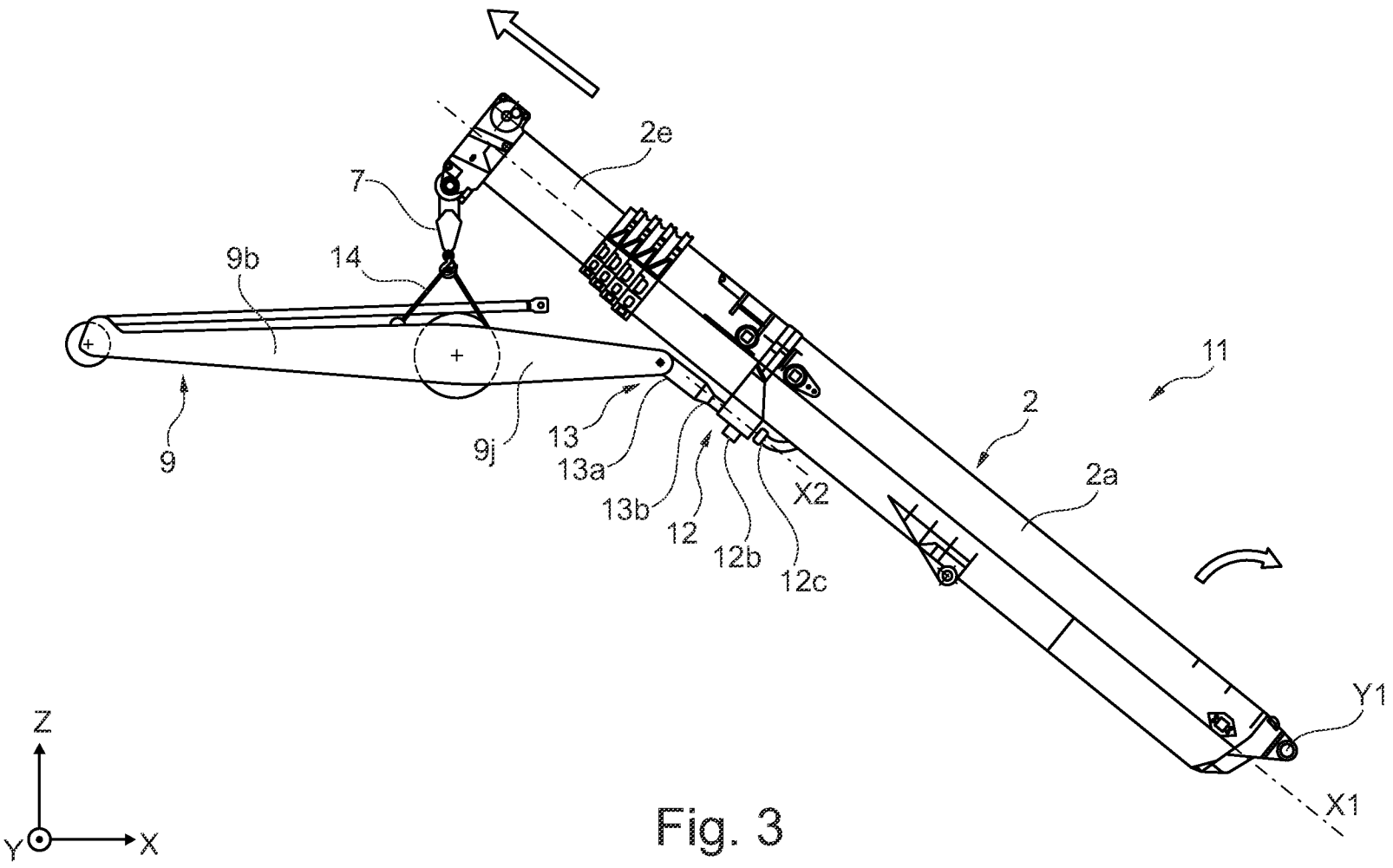
FIG. 3 shows the vehicle crane system from FIG. 2 in an uncoupled state in a changed orientation.

FIG. 3 shows the condition in which the bracing apparatus 9 has been raised completely from the transport means 8—which can no longer be seen in this figure—by means of the load picking-up means 7. Raising occurs in a conventional manner by reeling in the lifting cable on the load picking-up means 7. Luffing of the telescoping jib 2 or extending an inner box 2*a* to 2*e* can also effect raising or lowering of the load picking-up means 7. Any combination of these three movements is also possible for this purpose. Moreover, the telescoping jib 2 has been luffed up about the luffing axis Y1 (see black, curved arrow) and thus positioned more steeply compared with the illustration in FIG. 2. At the same time or following on therefrom, the inner box 2*e* located at the free end of the telescoping jib 2 has been linearly displaced and so the telescoping jib 2 is at least partially extended (see black, straight arrow). As can be seen, by way of the combination of luffing and extending the telescoping jib 2 and raising or lowering the load picking-up means 7 via the lifting cable, the two plug connection parts 12, 13 are orientated with respect to each other such that the plug element 13*a* of the second plug connection part 13 faces substantially in the direction of the opening channel 12*a* of the first plug connection part 12. Preferably, the plug element 13*a* is orientated with its longitudinal extension in parallel with the plug axis X2. Moreover, arranged on the end of the plug element 13*a* is a supply plug part 13*b*, via which the bracing apparatus 9 can be coupled to the vehicle crane 1 electrically and hydraulically. As a counterpart for the supply plug part 13*b*, a supply coupling part 12*c* is indicated in the drawing on the first plug connection part 12 in the region of its base.

This mutually adjacent arrangement of the two plug connection parts 12, 13 can be achieved in such a manner because the luffing angle of the telescoping jib 2, the extension length of the telescoping jib 2 and the mounting locations of the two plug connection parts 12, 13 in each case on the basic box 2*a* of the telescoping jib 2 and on an inner end of the bracing apparatus 9 are adapted to one another accordingly.

Prior to the coupling, the bracing apparatus 9 is orientated with its longitudinal extension in parallel with the longitudinal extension of the telescoping jib 2. The orientation of the bracing apparatus 9 with respect to the telescoping jib 2 is effected in a virtually automatic manner because the bracing apparatus 9 is freely suspended on the load picking-up means 7. For this purpose, the load picking-up means 7 is then selected such that the load picking-up means 7 is formed rigid in relation to a vertical axis of rotation, which typically coincides with the longitudinal direction of the lifting cables and the guiding of the load picking-up means 7 over the cable reeving of the lifting cable is sufficient to orientate the bracing apparatus 9 with its longitudinal direction lying in a luffing plane of the telescoping jib 2 and thus in parallel with its longitudinal direction for the longitudinal extension of the telescoping jib 2 automatically for the coupling process. If the load picking-up means 7 comprises a load hook rotatable about a vertical axis for picking up the bracing apparatus 9, it is possible to provide guide cables freely suspended downwards on the bracing apparatus 9, via which auxiliary personnel can then orientate the bracing apparatus 9 into the desired position with respect to the telescoping jib 2. It would also be feasible for load picking-up means 7 to be fitted with a driven rotary apparatus, in particular a remotely operable rotary apparatus, in order to orientate the bracing apparatus 9 with respect to the telescoping jib 2 prior to coupling about a vertical axis. The required precise orientation between the bracing apparatus 9 and the telescoping jib 2 can also be effected via the designs of the mechanical elements for the coupling process and thus by the coupling process itself.

Figure 4:
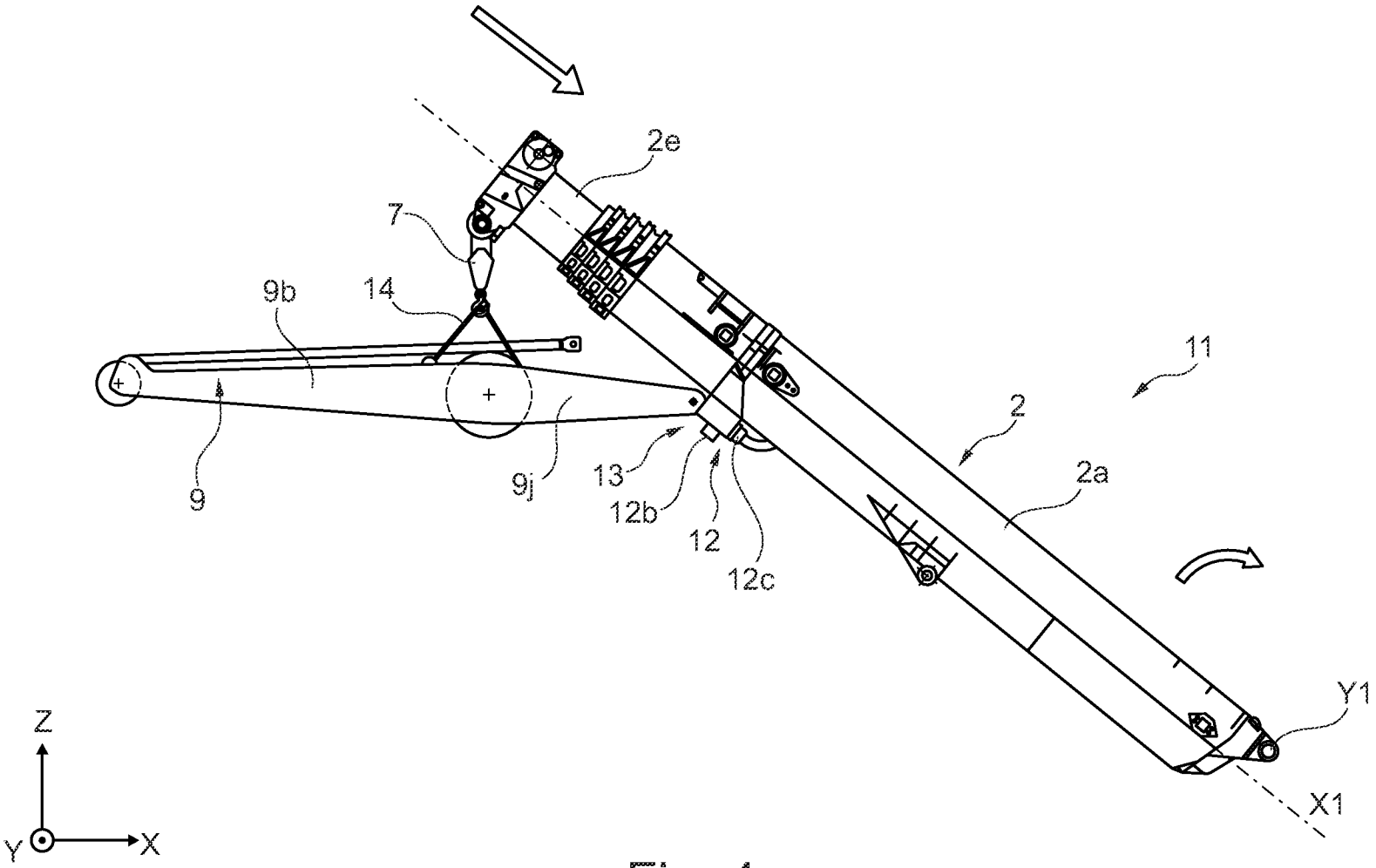
FIG. 4 shows the vehicle crane system from FIG. 3 in a coupled state.

FIG. 4 shows the now-secured condition of the bracing apparatus 9 on the basic box 2*a* of the telescoping jib 2. As can be seen, the first and second plug connection parts 12, 13 are coupled together by retracting the telescoping jib 2 or its inner box 2*e* (see black, straight arrow). By retracting the inner box 2*e*, the plug element 13*a* of the second plug connection part 13 was displaced into the opening channel 12*a* of the first plug connection part 12, thus forming a plug connection. Then, the first plug connection part 13 is locked in the first plug connection part 12 automatically or manually via a bolt-like locking element 12*b* on the first plug connection part 12. In the achieved mounting position, the bracing apparatus 9 is additionally connected to the telescoping jib 2 or the vehicle crane 1 in the region of the first and second plug connection parts 12, 13 manually or automatically via hydraulic and/or electric supply lines which are not illustrated in more detail.

Figure 5:
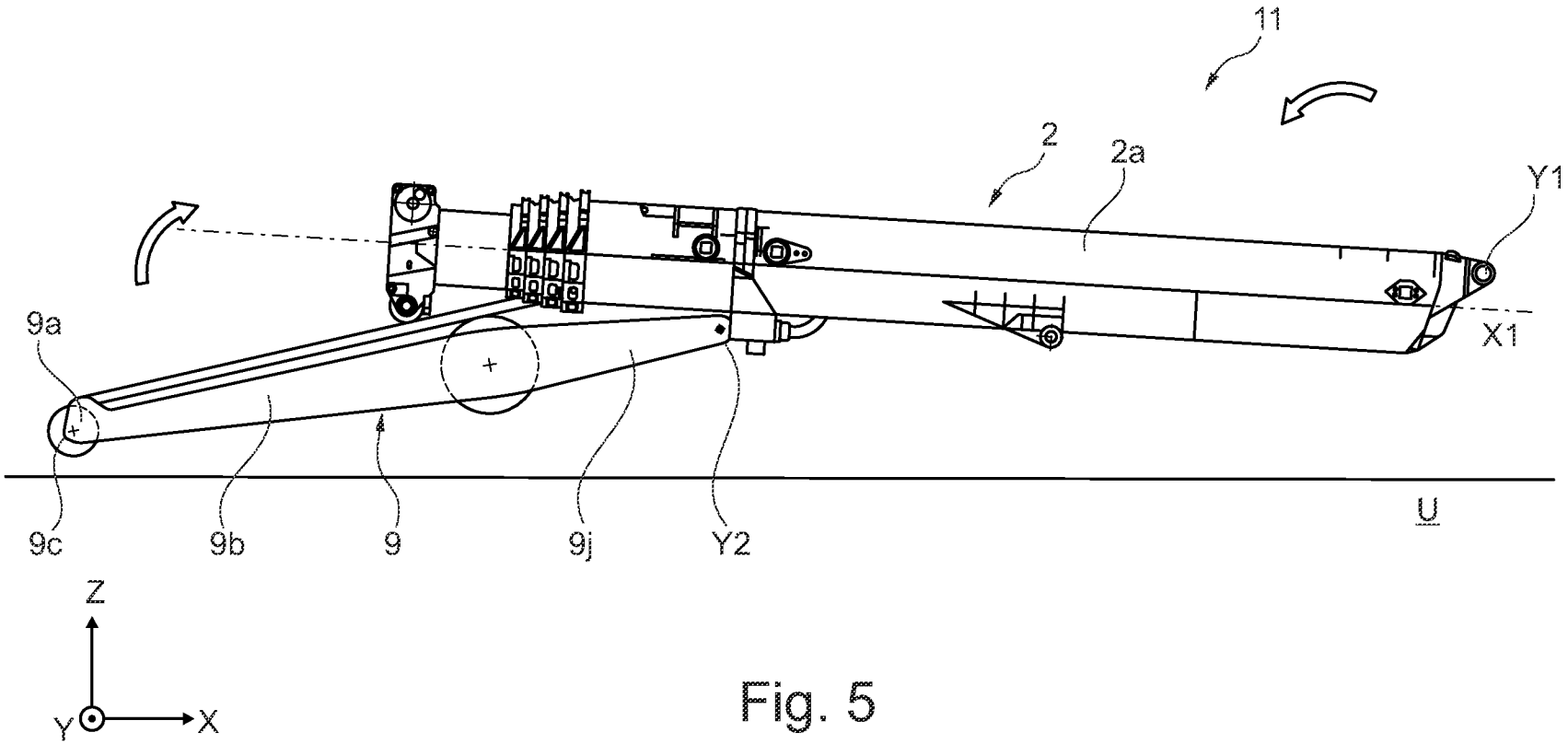
FIG. 5 shows the vehicle crane system from FIG. 4 with a changed orientation of the telescoping jib and the bracing apparatus.

FIG. 5 shows the next step in the rigging of the telescoping jib 2 with the bracing apparatus 9 in order to remove the suspension 14 from the load picking-up means 7 and the bracing apparatus 9. Compared with the position shown in FIG. 4, the telescoping jib 2 is luffed down far enough with respect thereto (see black, curved arrow) and the bracing apparatus 9 is positioned onto an erecting cylinder 9*d*, illustrated for the first time in FIG. 12, far enough about a pivot axis Y2 (see black, curved arrow) so that the suspension 14 is moved in a favourable working position in relation to the ground U in order then to remove the suspension 14 from the bracing apparatus 9 and the load picking-up means 7. In this condition, the bracing apparatus 9 is already carried completely by the basic box 2*a* of the telescoping jib 2. The suspension 14 which hereby can be relieved of the previous tension force and in this respect is relaxed can thus be removed. The bracing apparatus 9 suspended on the telescoping jib 2 hovers over the ground U with its free end 9*a* and a rotatably arranged deflecting roller 9*c*.

Figure 6:
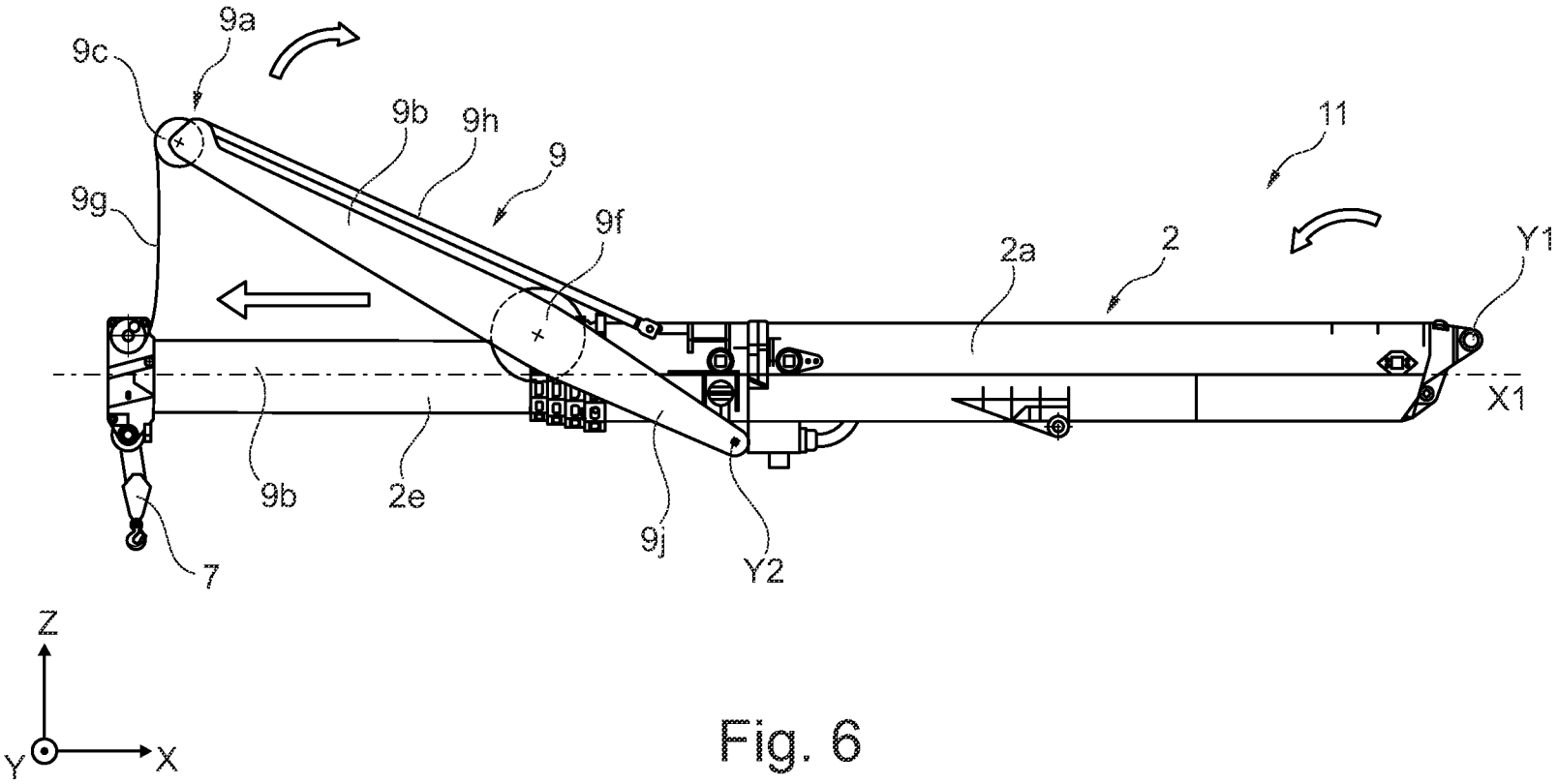
FIG. 6 shows the vehicle crane system from FIG. 5 with a changed orientation of the bracing apparatus and the telescoping jib.

FIG. 6 shows the vehicle crane system 11 from FIG. 5 with a changed orientation of the telescoping jib 2 and the bracing apparatus 9 compared with FIG. 5. The telescoping job 2 has been luffed down further and so its longitudinal direction X1 is orientated virtually horizontally and thus the telescoping jib head 2*f* can be reached more easily. The two bracing supports 9*b* have been erected further and so the free end 9*a* of the bracing apparatus 9 is located above the telescoping jib 2. Moreover, the fourth inner box 2*e* has been extended with the telescoping jib head 2*f* far enough that the free end 9*a* of the bracing apparatus 9 is located approximately above the telescoping jib head 2*f*. Then, a front tensioning cable 9*g* is fed out from tensioning frames 9*f* arranged on each of the two bracing supports 9*b* and is guided in each case along the bracing supports 9*b* in the direction of the respective free ends 9*a* to the deflecting roller 9*c* at that location, and then is freely suspended thereunder in the direction of the telescoping jib head 2*f*. Then, the tensioning cable 9*g* is fastened with its free end at the top on the telescoping jib head 2*f*. In this case, the tensioning frame 9*f* is articulated in each case in the region of a lower third of the bracing support 9*b*. It can also be seen from FIG. 6 that in each case a rear bracing rod 9*h* is mounted in an articulated manner on the free end 9*a* of each of the bracing supports 9*b*. The bracing rod 9*h* is shown lying in a rest position on the upper side of the bracing support 9*b*.

Figure 7:
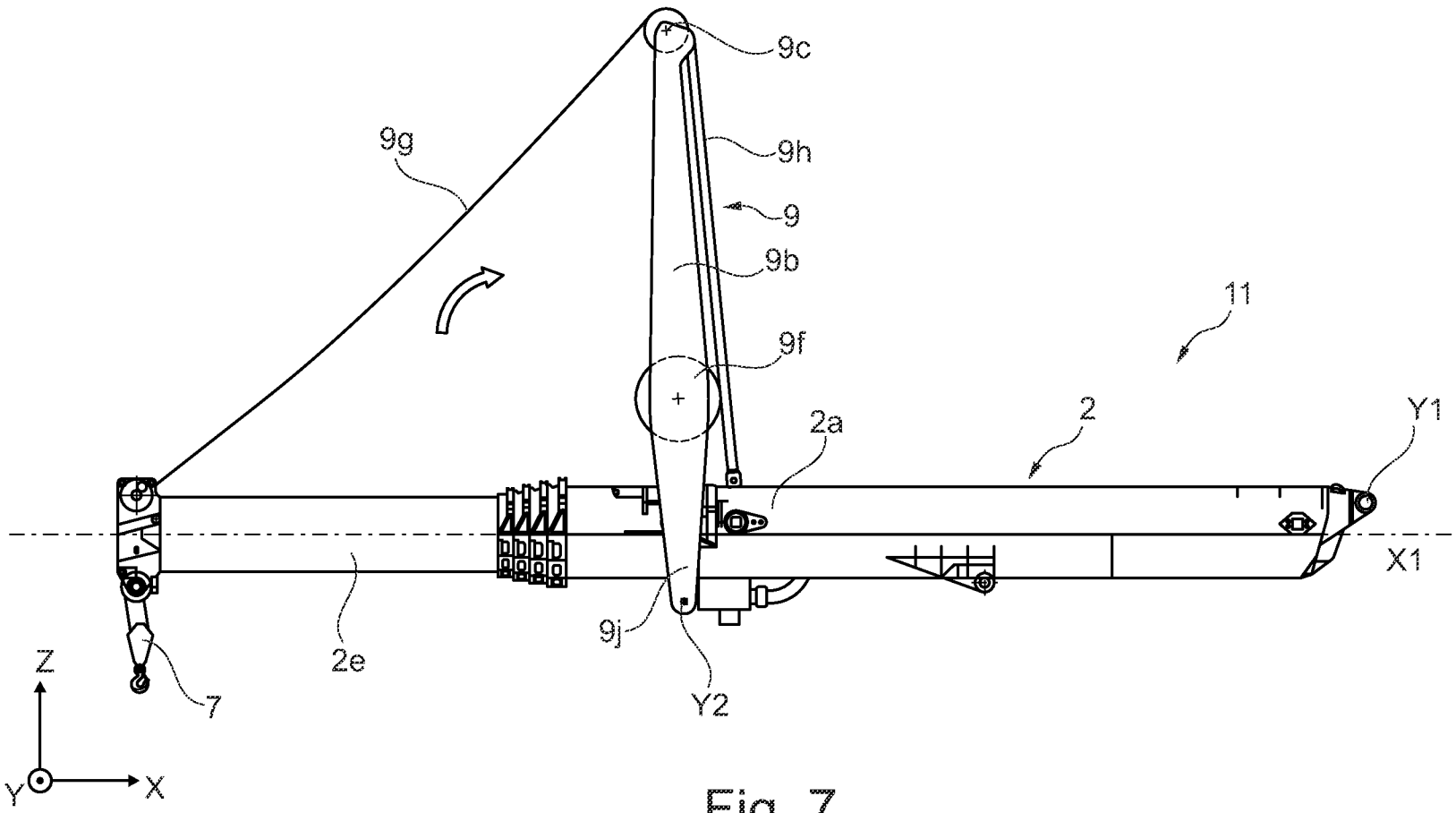
FIG. 7 shows the vehicle crane system from FIG. 6 with an orientation of the bracing apparatus which has further changed with respect thereto.

FIG. 7 shows the vehicle crane system 11 with a virtually vertically positioned bracing support 9*b* compared with FIG. 6. A further tensioning cable 9*g* has been fed out from the tensioning frame 9*f* in a corresponding manner.

FIG. 8 shows the vehicle crane system 11 from FIG. 7 with a telescoping jib 2 which has been luffed up in comparison therewith about the luffing axis Y1 far enough that the bracing rod 9*h* is freely suspended perpendicularly on the telescoping jib foot 2*g* via its fastening point. As a result of gravitational force, the bracing rod 9*h* has pivoted out of its rest position, lying on the bracing support 9*b*, into a perpendicular mounting position.

Figure 9:
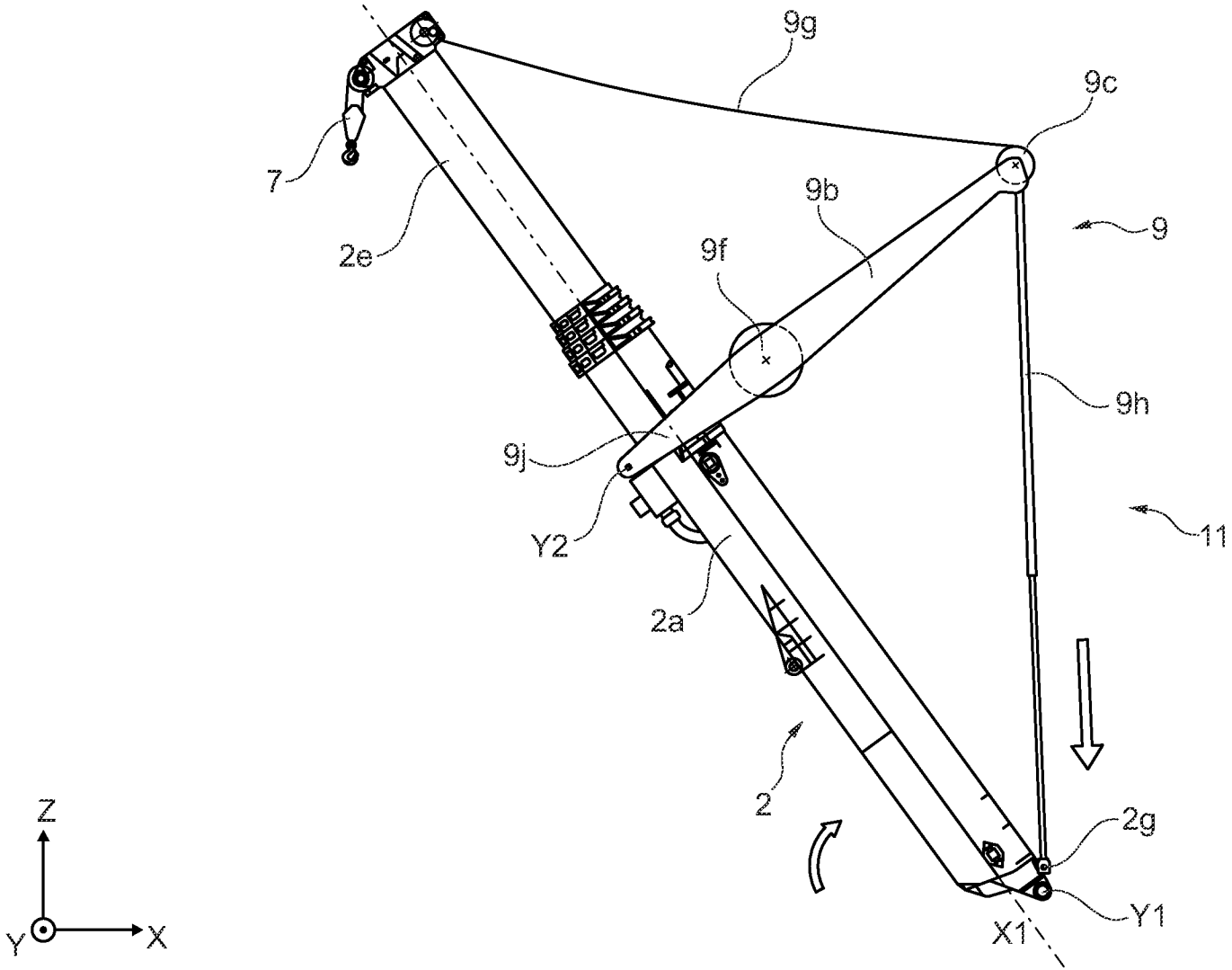
FIG. 9 shows the vehicle crane system from FIG. 8 with an extended bracing rod.

FIG. 9 substantially coincides with FIG. 8, wherein the bracing rod 9*h* is formed so as to be linearly extendible with an inner rod and has already been extended far enough that its free end can be fastened, in particular bolted, in the region of the telescoping jib foot 2*g*. The bracing rod 9*h* can be extended e.g. by an electrical cable winch, not shown, which is a component of the bracing apparatus 9. Of course, this cable winch can then also be used to retract the bracing rod 9*h*. Moreover, the bracing rod 9*d* is locked in its extended position in relation to its length.

Figure 10:
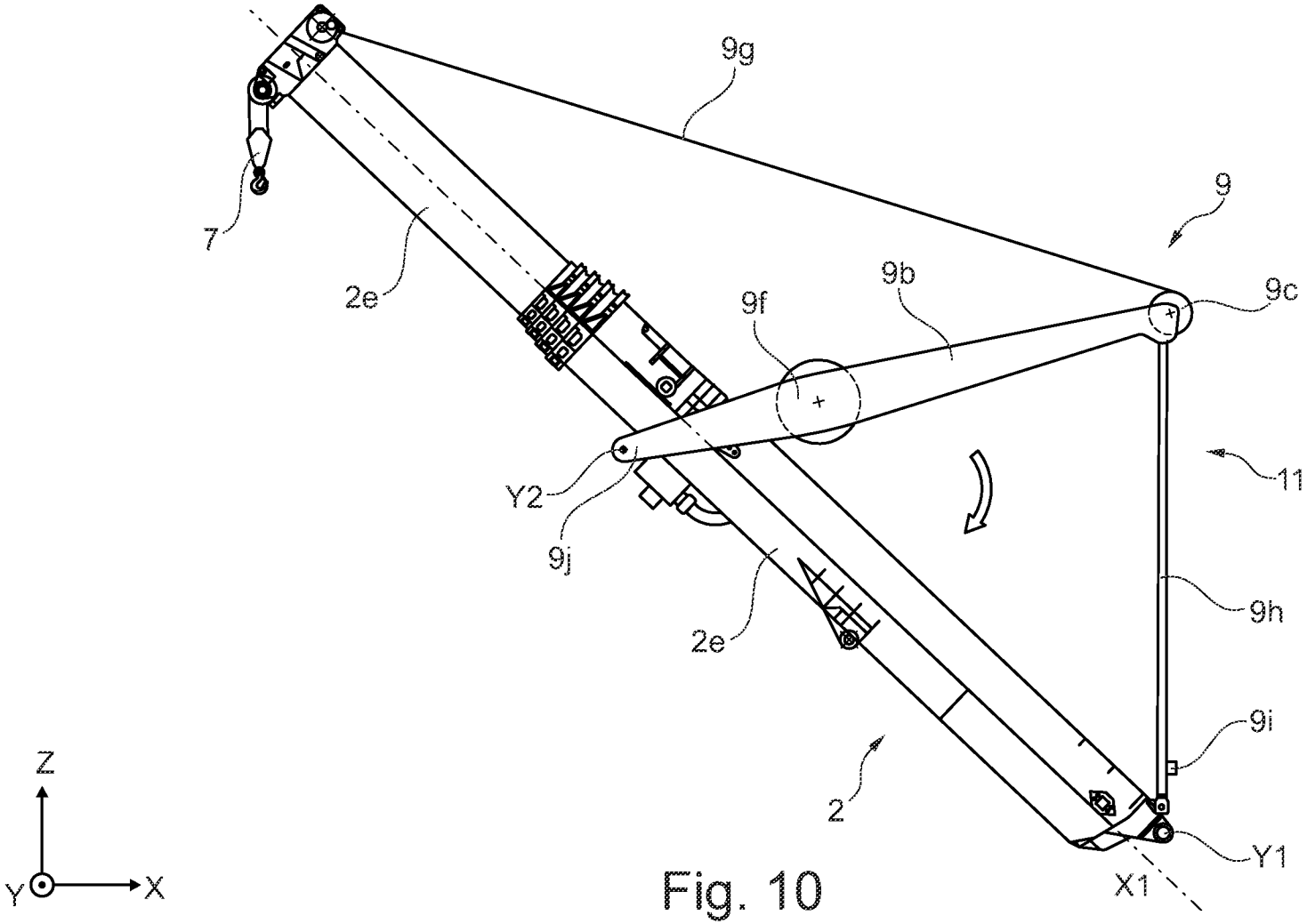
FIG. 10 shows the vehicle crane system from FIG. 8 with an alternative design for connecting the bracing rod.

FIG. 10 shows the vehicle crane system 11 from FIG. 8, wherein—compared to FIG. 9—the bracing rod 9*h* is fastened to the telescoping jib foot 2*g* in an alternative manner. For this purpose, the bracing support 9*b* is pivoted in the direction of the telescoping jib foot 2*g* beyond the 90° position until the free end of the bracing rod 9*h* can be fastened, in particular bolted, in the region of the telescoping jib foot 2*g*. Then, the bracing rod 9*h*—which can likewise be extended or lengthened by means of an inner rod—is unlocked via a securing element 9*i*, and so in a next step the bracing support 9*b* can be pivoted back into the 90° position and the bracing rod 9*h* is extended into its maximally extendible position.

Figure 11:
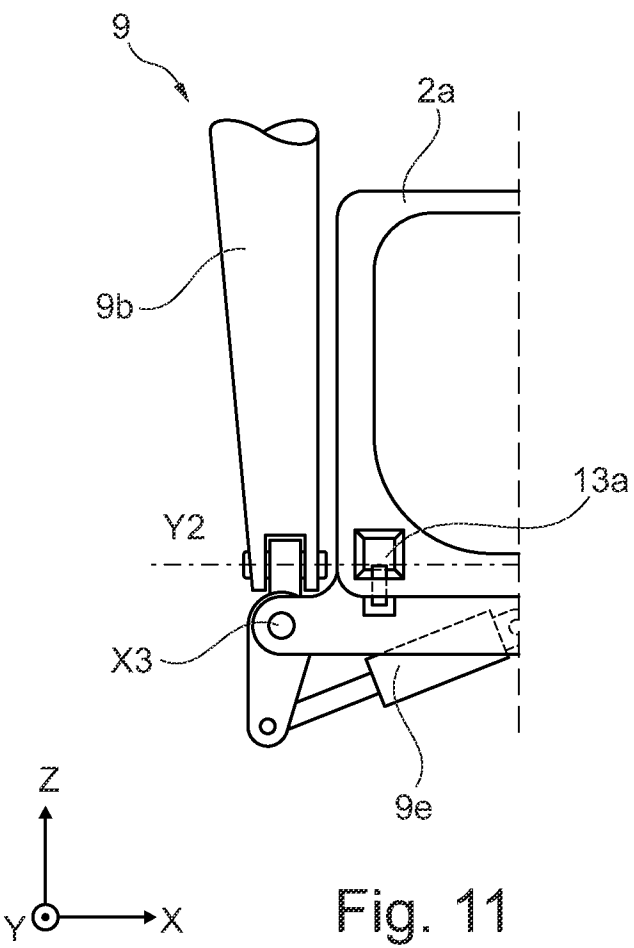
FIG. 11 shows a schematic view of an articulation of a bracing support on a basic box.

FIG. 11 shows a schematic view of an articulation of a bracing support 9*b* on a basic box 2*a* of a telescoping jib 2. It can be seen that the bracing support 9*b* can be pivoted about an erecting axis Y2 between a plurality of mounting positions (see FIGS. 3 to 6) into an operating position (see FIGS. 7 and 8). Moreover, the bracing support 9*b* can be pivoted out about a pivot axis X3 laterally into the v-shaped operating position. A hydraulic pivot cylinder 9*e* is provided for this pivoting movement.

Figure 12:
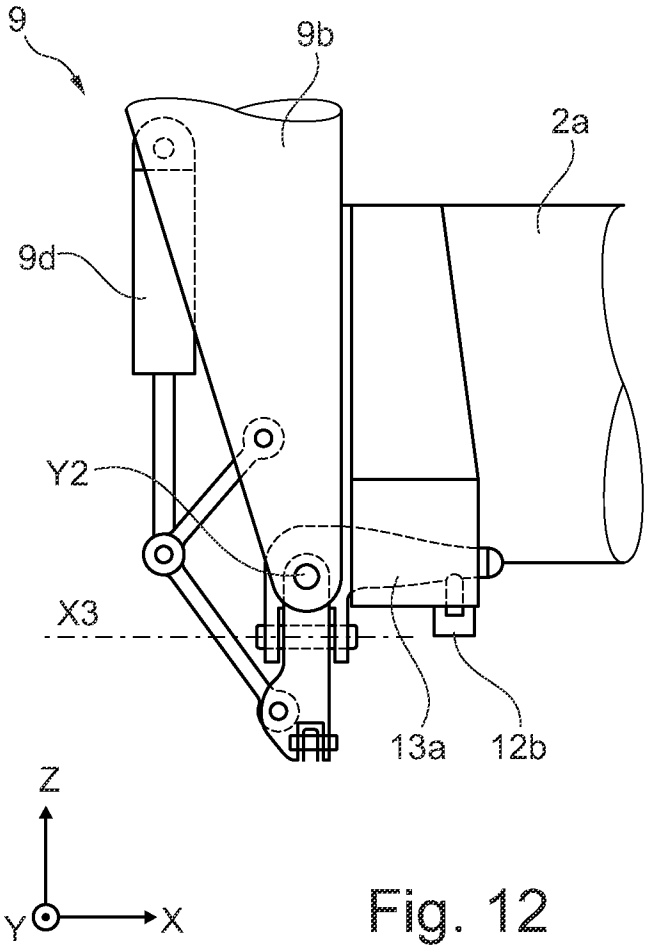
FIG. 12 shows a side view of FIG. 11.

FIG. 12 shows a side view of FIG. 11. The erecting axis Y2 and the pivot axis X3 can also be seen in this view. In addition, a hydraulic erecting cylinder 9*d* for the movement about the erecting axis Y2 is shown.

Although the mechanical elements for coupling the bracing apparatus 9 to the fastening region of the basic box or the inner box are formed as first and second plug connection parts in the previously described exemplified embodiment, it is self-evident that other structural designs are also possible. It is essential that these mechanical elements can be engaged with one another via a linear, circular and/or spherical joining movement towards each other. Therefore, hooks which grasp a bolt with their opening are feasible as a possible other design for the mechanical elements. The coupling direction, in which the two mechanical elements are moved towards each other and engaged with each other, does not have to be from top to bottom and in parallel with the longitudinal extension of the telescoping jib as described in the exemplified embodiment but can also be from bottom to top, from front to back, from back to front or in any oblique position with respect to the longitudinal direction of the telescoping jib. Accordingly, the fastening region can be arranged on the lower side and also on the sides of the basic box or one of the inner boxes. Provision can also be made that the first plug connection part is arranged not only at the bottom but also on the sides or at the top of the telescoping jib. In a conventional manner, the transport unit for the bracing apparatus is a semi-trailer. Transport can also be effected on loading surfaces of heavy-goods vehicles or associated trailers. Other components of a mobile crane, such as e.g. counterweights or lattice mast jib sections are mostly transported together with the bracing apparatus.

The embodiments of the invention in which an exclusive property or privilege is claimed are defined as follows:

1. A vehicle crane comprising:

a telescoping jib, comprising a basic box having linearly displaceable inner boxes and having a lifting cable having a load pick-up device, wherein a fastening region is arranged on the basic box or on a head end of one of the inner boxes; and a bracing apparatus that is configured to be secured to the fastening region at a connecting end of the bracing apparatus;

wherein the fastening region is formed for mounting the bracing apparatus on the basic box or on one of the inner boxes with the bracing apparatus being coupled to the fastening region from a freely suspended orientation on the lifting cable to the connecting end being brought close to the fastening region by movements of the vehicle crane, by retraction and extension of the inner boxes, raising and lowering of the load pick-up device and/or luffing of the telescoping jib.

2. The vehicle crane as claimed in claim 1, wherein in the fastening region a first plug connection part configured to form a plug connection is arranged on the basic box or on one of the inner boxes and can be coupled to a corresponding second plug connection part arranged on the connecting end of the bracing apparatus.

3. The vehicle crane as claimed in claim 2, wherein the first plug connection part comprises an opening channel provided to at least partially accommodate the second plug connection part comprising a plug element, and wherein the extension of the opening channel defines a plug axis extending in parallel with a longitudinal axis of the basic box.

4. The vehicle crane as claimed in claim 2, wherein the first plug connection part comprises a plug element provided for the at least partial arrangement in an opening channel of the second plug connection part, and wherein the extension of the plug element defines a plug axis extending in parallel with a longitudinal axis of the basic box.

5. The vehicle crane as claimed in claim 2, wherein the basic box and each inner box has an upper side and a lower side opposite the upper side, and wherein the first plug connection part is arranged on the lower side of the basic box or of the inner box on the head end thereof.

6. The vehicle crane as claimed in claim 2, wherein the bracing apparatus has the second plug connection part that corresponds to the first plug connection part of the telescoping jib and is articulated on the bracing apparatus.

7. The vehicle crane as claimed in claim 2, wherein the first plug connection part and/or the second plug connection part comprises an insertion aid in the form of at least one oblique surface.

8. The vehicle crane as claimed in claim 1, wherein the bracing apparatus has two articulated bracing supports and at least one drive, wherein when the bracing apparatus is coupled to the basic box the bracing supports can be pivoted from a mounting position into a working position and back at least partially by the drive.

9. The vehicle crane as claimed in claim 1, wherein at least one rotatably mounted deflecting roller is arranged on a free end of the bracing apparatus.

10. A vehicle crane system comprising a vehicle crane as claimed in claim 1, and a transport unit configured to transport the bracing apparatus of the telescoping jib system.

11. A method for mounting a bracing apparatus to a telescoping jib of a vehicle crane comprising:

providing a transport unit having a bracing device accommodated thereon in the region of a vehicle crane, wherein the bracing device has a connecting end;

connecting a load pick-up device of the vehicle crane to the bracing apparatus;

raising the bracing apparatus from the transport unit via the vehicle crane;

moving the bracing apparatus freely suspended on a lifting cable by retraction and extension of inner boxes, raising and lowering of the load pick-up device and/or luffing of the telescoping jib with respect to a fastening region on a basic box or on a head end of one of the inner boxes with respect to the fastening region;

coupling the bracing apparatus to the fastening region of the basic box or one of the inner boxes; and releasing the load pick-up device of the vehicle crane from the bracing apparatus.

12. The method as claimed in claim 11, wherein the bracing apparatus is coupled to the fastening region by moving the bracing apparatus freely suspended on the lifting cable.

13. The method as claimed in claim 11, wherein the bracing apparatus is mechanically secured after coupling to the fastening region.

14. The method as claimed in claim 11, wherein a second plug connection part on the bracing apparatus is coupled to a first plug connection part corresponding to the second plug connection part.

15. The method as claimed in claim 14, wherein the first plug connection part is coupled to the second plug connection part by retracting at least one of the inner boxes.

16. The method as claimed in claim 11, wherein two bracing supports articulated on the bracing device are pivoted from a mounting position into a working position at least partially by at least one drive.

17. The method as claimed in claim 11, further comprising orienting a longitudinal extension of the bracing apparatus in parallel with a longitudinal extension of the telescoping jib prior to said coupling the bracing apparatus to the fastening region of the basic box or one of the inner boxes.

* * * * *